US010132317B2

(12) United States Patent
Lynch

(10) Patent No.: US 10,132,317 B2
(45) Date of Patent: Nov. 20, 2018

(54) OIL RETURN WITH NON-CIRCULAR TUBE

(71) Applicant: Todd M. Lynch, East Syracuse, NY (US)

(72) Inventor: Todd M. Lynch, East Syracuse, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 226 days.

(21) Appl. No.: 14/969,945

(22) Filed: Dec. 15, 2015

(65) Prior Publication Data

US 2017/0167489 A1 Jun. 15, 2017

(51) Int. Cl.
*F04C 29/02* (2006.01)
*F04C 18/02* (2006.01)
*F04C 23/00* (2006.01)

(52) U.S. Cl.
CPC ..... *F04C 29/026* (2013.01); *F04C 18/0215* (2013.01); *F04C 23/008* (2013.01)

(58) Field of Classification Search
CPC ... F04C 29/026; F04C 18/0215; F04C 23/008
USPC ..... 418/55.2; 417/371, 410.5, 53
See application file for complete search history.

(56) References Cited

U.S. PATENT DOCUMENTS 6,139,295 A * 10/2000 Utter ..... F01C 17/06 418/55.5
6,171,084 B1 1/2001 Wallis et al.
6,315,536 B1 * 11/2001 DeVore ..... F04C 29/026 418/100
6,398,530 B1 6/2002 Hasemann
6,428,292 B1 8/2002 Wallis et al.
6,582,211 B2 6/2003 Wallis et al.
6,814,551 B2 11/2004 Kammhoff et al.
6,960,070 B2 11/2005 Kammhoff et al.
7,112,046 B2 9/2006 Kammhoff et al.
7,997,877 B2 8/2011 Beagle et al.
2004/0170509 A1 * 9/2004 Wehrenberg ..... F04C 23/008 417/371
2006/0045761 A1 3/2006 Oa et al.
2012/0082578 A1 4/2012 Nakamura et al.
(Continued)

FOREIGN PATENT DOCUMENTS

EP 1911975 A1 4/2008

*Primary Examiner* — Laert Dounis
*Assistant Examiner* — Kelsey Stanek
(74) *Attorney, Agent, or Firm* — Reinhart Boerner Van Deuren P.C.

(57) ABSTRACT

A scroll compressor includes a housing and scroll compressor bodies disposed in the housing. The scroll bodies include first and second scroll bodies. The first and second scroll bodies have respective bases and respective scroll ribs that project from the respective bases. The scroll ribs mutually engage, such that the second scroll body is movable relative to the first scroll body for compressing fluid. An oil return tube delivers oil from an upper region of the housing to an oil sump in a lower region of the housing. The relatively longer portion is positioned substantially vertically within the housing. The relatively longer tubular portion is non-circular and may have at least one stepped portion which corresponds to a step in the interior surface of the housing. In some embodiments, the oil return tube has a short tubular portion attached at one end to a relatively longer tubular portion.

16 Claims, 5 Drawing Sheets

(56) References Cited

U.S. PATENT DOCUMENTS

| | | | |
|---|---|---|---|
| 2012/0294748 | A1 | 11/2012 | Shiibayashi et al. |
| 2013/0251543 | A1 | 9/2013 | Duppert et al. |

* cited by examiner

OIL RETURN WITH NON-CIRCULAR TUBE

FIELD OF THE INVENTION

This invention generally relates to scroll compressors.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; U.S. Pat. No. 7,112,046 to Kammhoff et al.; and U.S. Pat. No. 7,997,877, to Beagle et al., all of which are assigned to a Bitzer entity closely related to the present assignee. As the present disclosure pertains to improvements that can be implemented in these or other scroll compressor designs, the disclosures of U.S. Pat. Nos. 6,398,530, 7,112,046, 6,814,551, and 6,960,070 are hereby incorporated by reference in their entireties.

Additionally, particular embodiments of scroll compressors are disclosed in U.S. Pat. No. 6,582,211 to Wallis et al., U.S. Pat. No. 6,428,292 to Wallis et al., and U.S. Pat. No. 6,171,084 to Wallis et al., the teachings and disclosures of which are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purpose of compressing refrigerant. An appropriate drive unit, typically an electric motor, is usually provided within the same housing to drive the movable scroll member.

Embodiments of the present invention pertain to improvements in the state of the art. These and other advantages of the invention, as well as additional inventive features, will be apparent from the description of the invention provided herein.

BRIEF SUMMARY OF THE INVENTION

In one aspect, the invention provides a scroll compressor that includes a housing. The scroll compressor includes scroll compressor bodies disposed in the housing. The scroll bodies include a first scroll body and a second scroll body. The first and second scroll bodies have respective bases and respective scroll ribs that project from the respective bases. The scroll ribs mutually engage, such that the second scroll body is movable relative to the first scroll body for compressing fluid. There is an oil return tube for delivering oil from an upper region of the housing to an oil sump in a lower region of the housing. The oil return tube has a tubular portion positioned substantially vertically within the housing. The tubular portion is non-circular. More particularly, in some embodiments, the shape of the tubular portion and the opening therein, is one of obround (also referred to as stadium-shaped), kidney shaped, and oval.

In a particular embodiment, the tubular portion has at least one stepped portion which corresponds to a step in the interior surface of the housing. In a more particular embodiment, the tubular portion has a first stepped portion at an upper end of the tubular portion and a second stepped portion at a lower end of the tubular portion. In a further embodiment, the tubular portion has a non-stepped portion between the first and second stepped portions. The tubular portion is non-circular in order to fit in the relatively tight space between interior surface of the housing and an outer surface of the drive unit or motor, while still allowing a substantial flow of oil through the oil return tube.

In this context, "a substantial flow" is a flow equal, or nearly equal, to that which could be obtained from a circular tube, and sufficient to allow adequate passage of oil required for lubrication of the bearings. In other embodiments, the non-circular tubular portion can fit in the relatively tight space between interior surface of the housing and an outer surface of a motor pressed into a motor spacer where the motor spacer is press-fit into the housing.

In a particular embodiment, the oil return tube is made from injection-molded plastic. Further, in certain embodiments, a short tubular portion is attached at one end of, and may be perpendicular to, the relatively longer aforementioned tubular portion. Also, the short tubular portion may be circular with a circular opening therein. In some embodiments, the first stepped portion is located at an upper end of the relatively longer tubular portion, and radially outward of the non-stepped portion, and the second stepped portion is located at a lower end of the relatively longer tubular portion, and is radially inward of the non-stepped portion.

In this embodiment, the second stepped portion abuts the motor or drive unit or a motor spacer placed onto the motor or drive unit. In a further embodiment, the first stepped portion follows a stepped contour of the interior surface of the housing such that the stepped contour supports and positions the oil return tube.

In certain embodiments, the oil return tube is configured to receive oil through an opening in the shorter portion and to discharge the oil from an opening in the relatively longer portion.

In some embodiments, the shorter tubular portion is disposed within an opening in a main bearing member. The scroll compressor assembly may further include an O-ring configured to fit onto the shorter tubular portion to provide a seal between the shorter tubular portion and the main bearing member opening.

The aforementioned scroll compressor may also include one or more guide strips placed on a radially-outward portion of the oil return tube, the one or more guide strips configured to facilitate the press-fitting of the oil return tube into the housing. In certain embodiments, the drive unit is inserted into an adaptor ring or motor spacer which is press-fit into the housing, and the relatively longer portion is situated in a space between the housing and the motor or drive unit.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
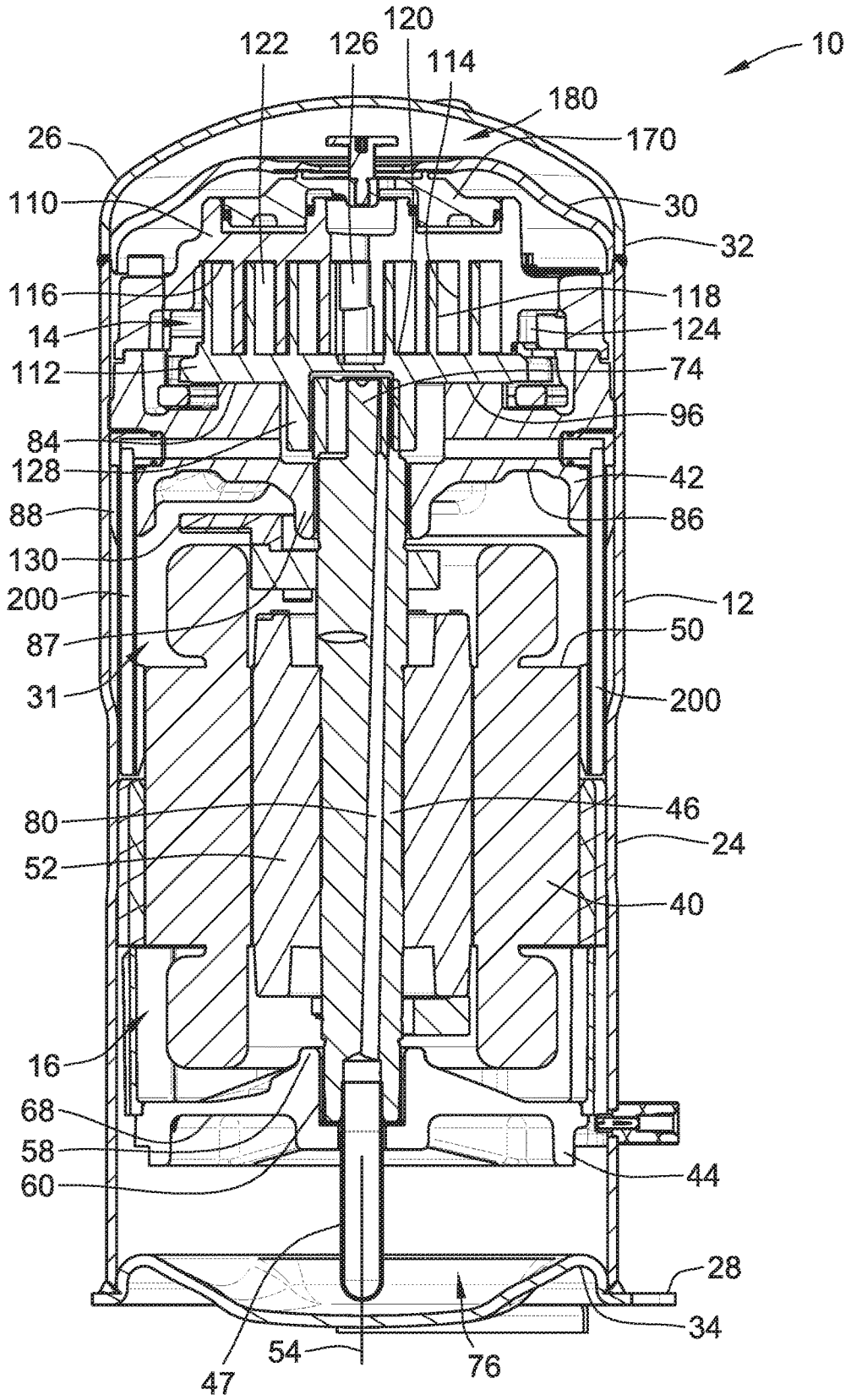
FIG. 1 is a cross-sectional isometric view of a scroll compressor assembly, which may incorporate an embodiment of the invention.
Figure 2:
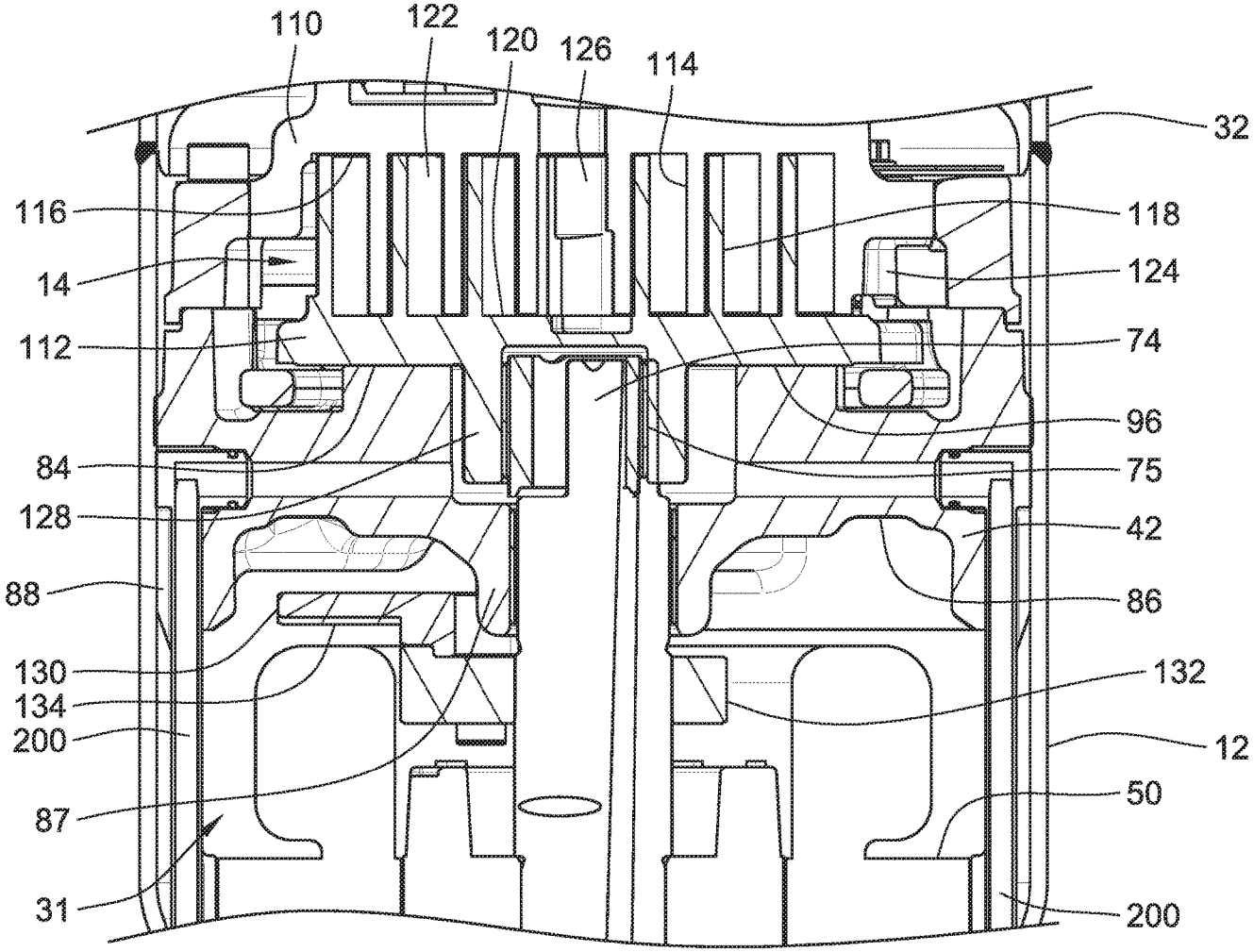
FIG. 2 is a cross-sectional isometric view of an upper portion of the scroll compressor assembly of FIG. 1.

An embodiment of the present invention is illustrated in FIGS. 1-2 as a scroll compressor assembly 10 generally including an outer housing 12 in which a scroll compressor 14 can be driven by a drive unit 16. The scroll compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port (not shown) and a refrigerant outlet port (not shown) extending through the outer housing 12. The scroll compressor assembly 10 is operable through operation of the drive unit 16 to operate the scroll compressor 14 and thereby compress an appropriate refrigerant or other fluid that enters the refrigerant inlet port and exits the refrigerant outlet port in a compressed high-pressure state.

The outer housing 12 for the scroll compressor assembly 10 may take many forms. In particular embodiments of the invention, the outer housing 12 includes multiple shell sections. In the embodiment of FIG. 1, the outer housing 12 includes a central cylindrical housing section 24, and a top end housing section 26, and a single-piece bottom shell 28 that serves as a mounting base. In certain embodiments, the housing sections 24, 26, 28 are formed of appropriate sheet steel and welded together to make a permanent outer housing 12 enclosure. However, if disassembly of the housing is desired, other housing assembly provisions can be made that can include metal castings or machined components, wherein the housing sections 24, 26, 28 are attached using fasteners.

As can be seen in the embodiment of FIG. 1, the central housing section 24 is cylindrical, joined with the top end housing section 26. In this embodiment, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. In particular embodiments, the central cylindrical housing section 24 is welded to the single-piece bottom shell 28, though, as stated above, alternate embodiments would include other methods of joining (e.g., fasteners) these sections of the outer housing 12.

Assembly of the outer housing 12 results in the formation of an enclosed chamber 31 that surrounds the drive unit 16, and partially surrounds the scroll compressor 14. In particular embodiments, the top end housing section 26 is generally dome-shaped and includes a respective cylindrical side wall region 32 that abuts the top of the central cylindrical housing section 24, and provides for closing off the top end of the outer housing 12. As can also be seen from FIG. 1, the bottom of the central cylindrical housing section 24 abuts a flat portion just to the outside of a raised annular rib 34 of the bottom end housing section 28. In at least one embodiment of the invention, the central cylindrical housing section 24 and bottom end housing section 28 are joined by an exterior weld around the circumference of a bottom end of the outer housing 12.

Figure 3:
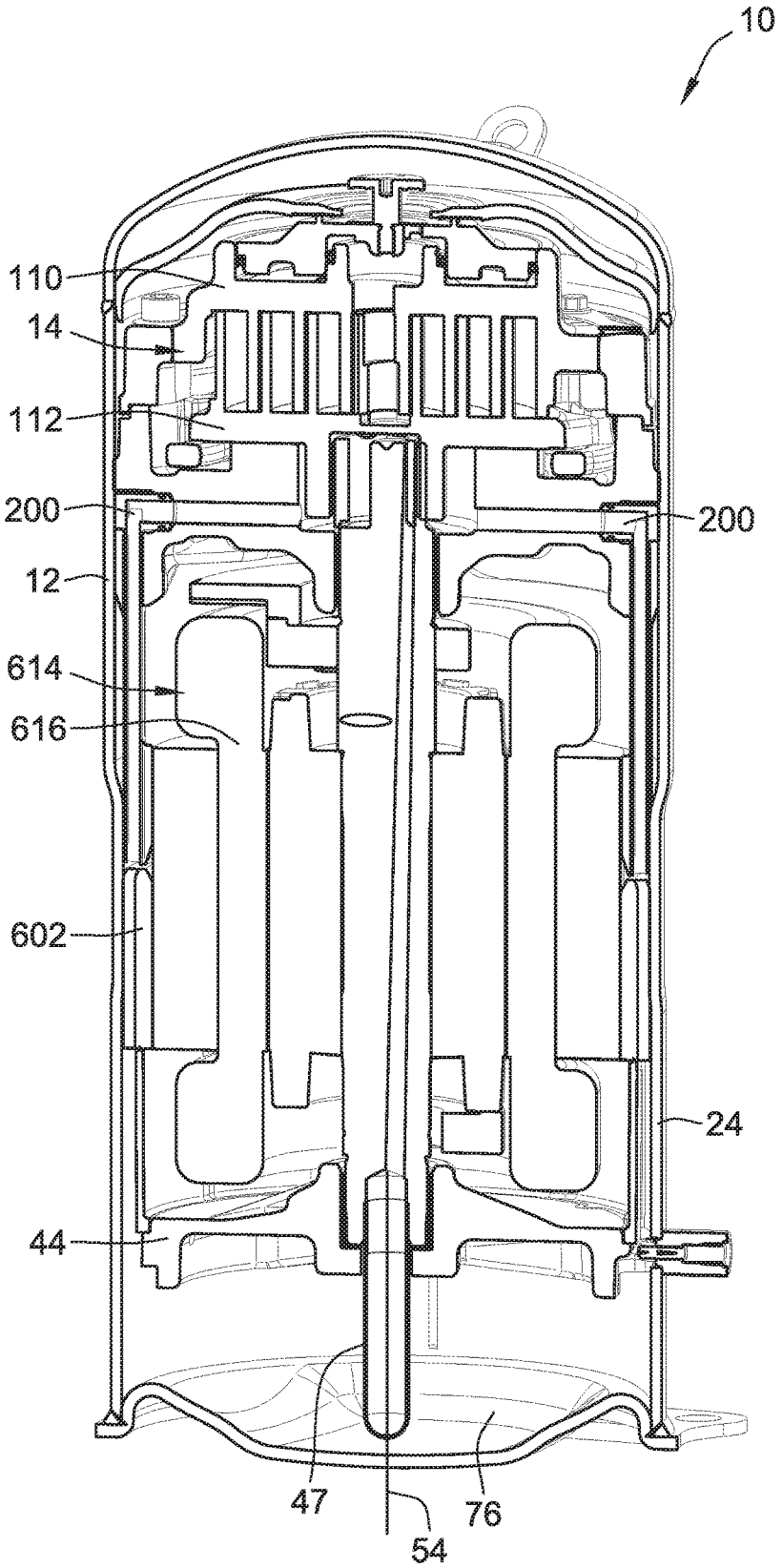
FIG. 3 is an isometric cross-section view of a scroll compressor that includes a motor spacer, and which may incorporate an embodiment of the present invention.

In a particular embodiment, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via an adapter. The stator 50 may be press-fit directly into outer housing 12, or may be fitted with adapter (an example of which is shown in FIG. 3) and press-fit into the outer housing 12. In a particular embodiment, the rotor 52 is mounted on the drive shaft 46, which is supported by upper and lower bearing members 42, 44. Energizing the stator 50 is operative to rotatably drive the rotor 52 and thereby rotate the drive shaft 46 about a central axis 54.

Applicant notes that when the terms "axial" and "radial" are used herein to describe features of components or assemblies, they are defined with respect to the central axis 54. Specifically, the term "axial" or "axially-extending" refers to a feature that projects or extends in a direction generally parallel to the central axis 54, while the terms "radial' or "radially-extending" indicates a feature that projects or extends in a direction generally perpendicular to the central axis 54. Some minor variation from parallel and perpendicular is permissible.

With reference to FIG. 1, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

The drive shaft 46 further includes an offset eccentric drive section 74 that has a cylindrical drive surface 75 about an offset axis that is offset relative to the central axis 54. This offset drive section 74 is journaled within a cavity of the movable scroll member 112 of the scroll compressor 14 to drive the movable scroll member 112 of the scroll compressor 14 about an orbital path when the drive shaft 46 is rotated about the central axis 54. To provide for lubrication of all of these bearing surfaces, the outer housing 12 provides an oil lubricant sump 76 at the bottom end in which suitable oil lubricant is provided. The drive shaft 46 has an impeller tube 47 that acts as an oil pump when the drive shaft 46 is spun and thereby pumps oil out of the lubricant sump 76 into an internal lubricant passageway 80 within the drive shaft 46. During rotation of the drive shaft 46, centrifugal force acts to drive lubricant oil up through the lubricant passageway 80 against the action of gravity. In a particular embodiment, the lubricant passageway 80 includes various radial passages to feed oil through centrifugal force to appropriate bearing surfaces and thereby lubricate sliding surfaces as may be desired.

The upper bearing member, or crankcase, 42 includes a central bearing hub 87 into which the drive shaft 46 is journaled for rotation. Extending outward from the central bearing hub 87 is a disk-like portion 86 that terminates in an intermittent perimeter support surface 88. In the embodiments of FIGS. 1 and 2, the central bearing hub 87 extends below the disk-like portion 86, while a thrust bearing 84 is assembled above the disk-like portion 86 and contains a thrust surface 96, which provides axial support for the moveable scroll compressor body 112. In certain embodiments, the intermittent perimeter support surface 88 is adapted to have an interference and press-fit with the outer housing 12.

Turning in greater detail to the scroll compressor 14, the scroll compressor body is provided by first and second scroll compressor bodies which preferably include a relatively stationary fixed scroll compressor member 110 and a second scroll compressor member 112 movable relative to the fixed scroll compressor member 110. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The second scroll compressor member 112 is arranged for orbital movement relative to the fixed scroll compressor member 110 for the purpose of compressing refrigerant. The fixed scroll compressor member 110 includes a first rib 114 projecting axially from a plate-like base 116 and is designed in the form of a spiral. Similarly, the second movable scroll compressor body 112 includes a second scroll rib 118 projecting axially from a plate-like base 120 and is in the design form of a similar spiral.

The scroll ribs 114, 118 engage in one another and abut sealingly on the respective base surfaces 120, 116 of the respectively other compressor body 112, 110. As a result, multiple compression chambers 122 are formed between the scroll ribs 114, 118 and the bases 120, 116 of the respective compressor bodies 112, 110. Within the chambers 122, progressive compression of refrigerant takes place. Refrigerant flows with an initial low pressure via an intake area 124 surrounding the scroll ribs 114, 118 in the outer radial region. Following the progressive compression in the chambers 122 (as the chambers progressively are defined radially inward), the refrigerant exits via a discharge port 126 which is defined centrally within the base 116 of the fixed scroll compressor member 110. Refrigerant that has been compressed to a high pressure can exit the chambers 122 via the discharge port 126 during operation of the scroll compressor.

The movable scroll compressor body 112 engages the eccentric offset drive section 74 of the drive shaft 46. More specifically, the receiving portion of the movable scroll compressor body 112 includes a cylindrical bushing drive hub 128 which slideably receives the offset eccentric drive section 74 with a slideable bearing surface provided therein. In detail, the offset eccentric drive section 74 engages the cylindrical drive hub 128 in order to move the second scroll compressor member 112 about an orbital path about the central axis 54 during rotation of the drive shaft 46 about the central axis 54. Considering that this offset relationship causes a weight imbalance relative to the central axis 54, the assembly preferably includes a counter weight 130 that is mounted at a fixed angular orientation to the drive shaft 46.

Referring to FIG. 2, the counter weight 130 acts to offset the weight imbalance caused by the eccentric offset drive section 74 and the movable scroll compressor body 112 that is driven about an orbital path (e.g. among other things, the scroll rib is not equally balanced). The counter weight 130 includes an attachment collar 132 and an offset weight region 134 that provides for the counter weight effect and thereby balancing of the forces of the rotating components about the central axis 54. This provides for reduced vibration and noise of the overall assembly by internally balancing or canceling out inertial forces.

Referring in greater detail to the fixed scroll compressor member 110, this body 110 is fixed to the upper bearing member 42, capturing the second scroll compressor member 112 between the fixed scroll member 110 and the upper bearing member 42. In a particular embodiment, a floating seal 170 is assembled to the fixed scroll compressor body 110, which together with the separator plate 30, separates a high pressure chamber 180 from the relatively lower pressure region of the compressor 14 contained within the outer housing 12.

FIGS. 1 and 2 also illustrate cross-sectional views of the scroll compressor assembly 10 with an oil return tube 200, in accordance with an embodiment of the invention. In the embodiments shown, a shorter tubular portion 202 (shown in FIGS. 5-7) is disposed within an opening in a main bearing member, such as upper bearing 42 in FIG. 1. An O-ring may be configured to fit onto the shorter tubular portion 202 to provide a seal between the shorter tubular portion 202 and the main bearing member 42 opening after insertion of the shorter tubular portion 202. The O-ring is not explicitly shown in the figures, but one of ordinary skill in the art will readily understand how an O-ring would be used in the manner described on the shorter tubular portion 202 of the oil return tube 200.

In certain embodiments, the aforementioned scroll compressor assembly 10 may also include an oil return tube 200 with one or more guide strips placed on a radially-outward portion of the oil return tube 200, the one or more guide strips configured to facilitate the press-fitting of the oil return tube 200 into the housing 12. Similarly, the guide strips are not explicitly shown in the drawings, but one skilled in the art would recognize and understand their use as described herein. The structure and operation of the oil return tube 200 is explained below in greater detail in the description of FIGS. 5-7.

FIG. 3 illustrates an alternative embodiment of the scroll compressor assembly 10 from FIG. 1. In this particular embodiment, a motor 614 includes an adaptor ring or motor spacer 602 that provides a larger outer diameter and periphery for the motor 614 for press fitting. Ideally, the housing 12 will have a center portion 24 diameter such that the motor assembly 40 (see FIG. 1) with a larger standard diameter stator 50 can easily fit into the center portion 24 without the adaptor ring 602. However, in the event that a motor 614 with a nonstandard size stator, or a smaller standard sized motor stator 616 that has sufficient output power is used, the center portion 24 is still capable of housing the motor 614 because it includes the motor spacer 602.

Figure 4:
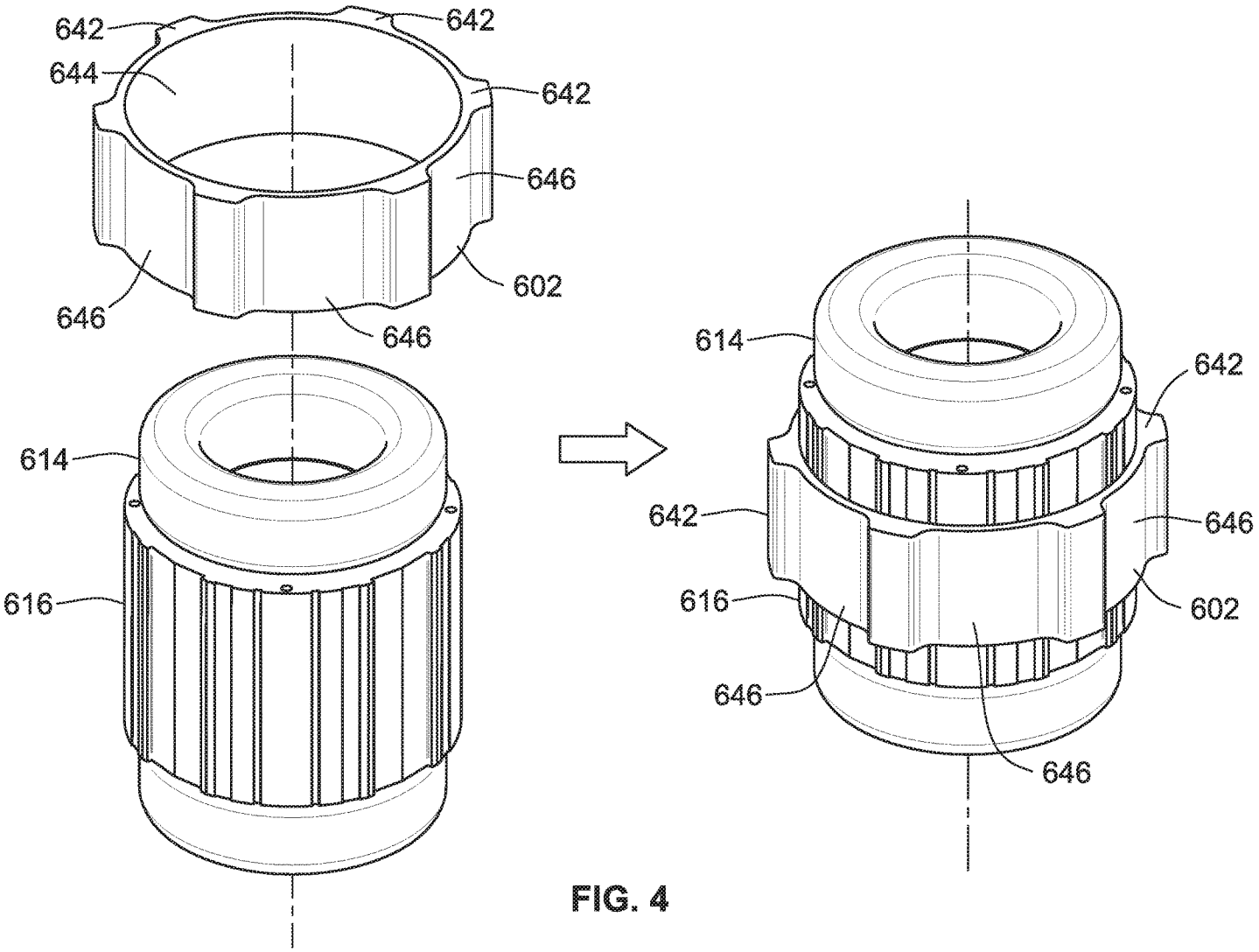
FIG. 4 is an exploded view of the motor including the motor spacer shown in FIG. 3.

FIG. 4 illustrates the motor 614 including the motor spacer 602. The motor spacer 602 includes a generally circular inner surface 644 with a diameter large enough that it wraps around the stator 616 of the motor 614. The inner surface 644 of the motor spacer 602 should have a tight grip around the stator 616 such that the motor spacer 602 does not slide off the stator 616 during the press fitting process.

As shown in FIG. 4, an external surface of the motor spacer 602 includes raised portions 642. The raised portions 642 are spaced periodically around the circumference of the motor spacer 602. The raised portions 642 are the portions of the motor spacer 602 that make contact with the inner surface of the housing 12. While the embodiment of the motor spacer 602 illustrated in FIG. 4 shows six raised portions 642, more or less than six raised portions 642 are contemplated. In between each raised portions 642 is a thin portion that forms a valley 646 that allows lubricant oil flowing downward toward the sump 76 (see FIG. 3) to flow around the motor spacer 602.

Figure 7:
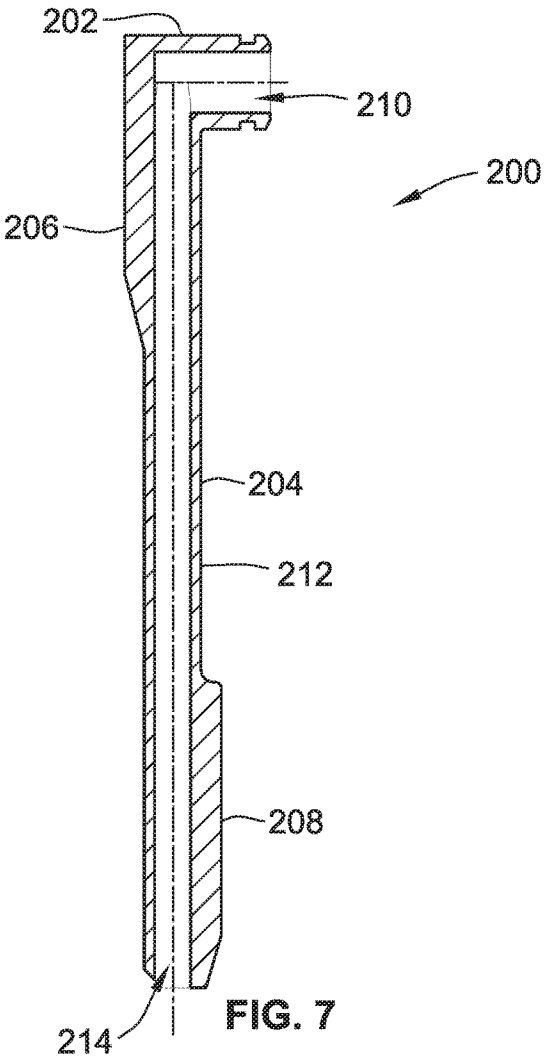
FIG. 7 is a cross-sectional view of the oil return tube of FIGS. 5 and 6.
Figure 6:
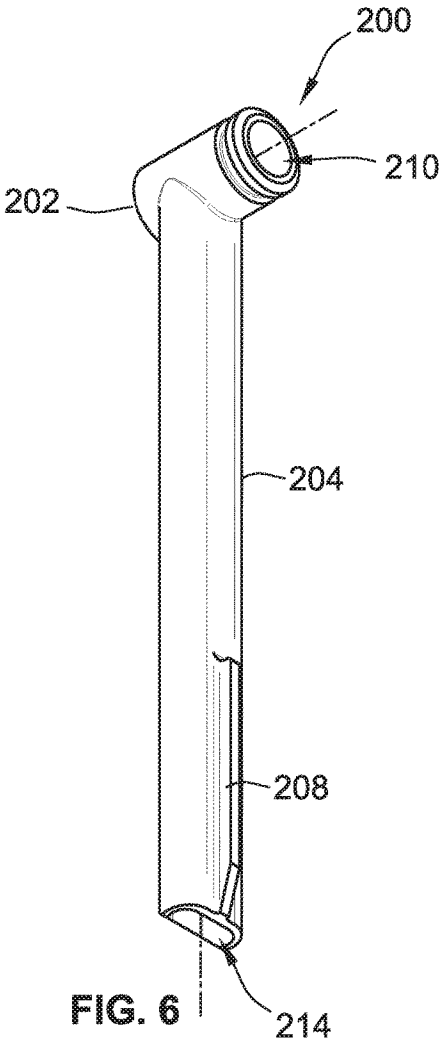
FIGS. 5 and 6 are rear and front perspective views of an oil return tube configured for use in a scroll compressor assembly, in accordance with an embodiment of the invention.
Figure 5:
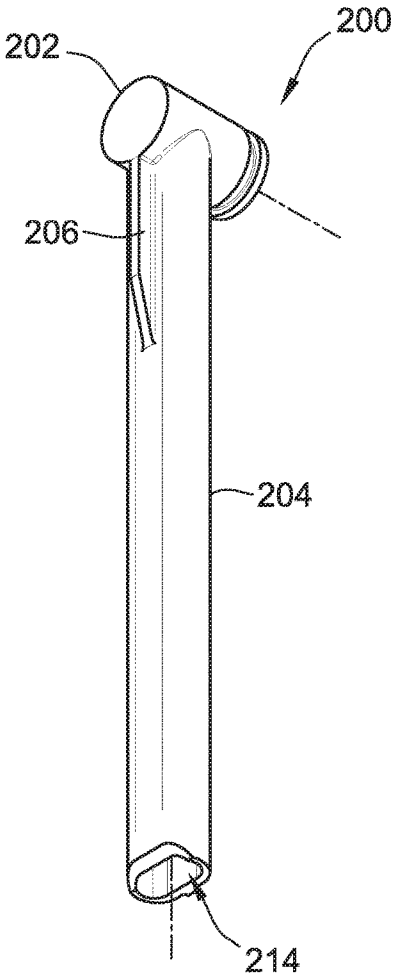

As stated above, oil is brought up from the oil sump 76 through the internal lubricant passageway 80 within the drive shaft 46 to lubricate bearing and sliding surfaces. This oil may be returned to the oil sump using an oil return tube 200, as shown in FIGS. 5-7. Specifically, the oil return tube 200 captures oil from the bearing and sliding surfaces around the scroll compressor assembly 14 (see FIG. 1) and returns the oil from an upper region of the housing 12 back to the oil sump 76 in a lower region of the housing 12.

FIGS. 5 and 6 are rear and front perspective views of the oil return tube 200 configured for use in the scroll compressor assemblies 10 of FIGS. 1 and 2, for example, in accordance with an embodiment of the invention. FIG. 7 is a cross-sectional view of the oil return tube 200 of FIGS. 5 and 6. For the scroll compressor assembly 10 of FIG. 1, the relatively longer tubular portion 204 is non-circular in order to fit in the relatively tight space between interior surface of the housing 12 and an outer surface of the drive unit 16 or motor 40, while still allowing a substantial flow of oil through the oil return tube 200. In this context, "a substantial flow" is a flow equal, or nearly equal, to that which could be obtained from a circular tube, and sufficient to allow adequate passage of oil required for lubrication of the bearings. In the scroll compressor of FIG. 3, for example, the non-circular relatively longer tubular portion 204 can fit in the relatively tight space between interior surface of the housing 12 and an outer surface of the motor spacer 602.

As can be seen from FIGS. 5-7, the oil return tube 200 includes a short tubular portion 202 attached at one end to a relatively longer tubular portion 204. In the embodiment shown, the relatively longer portion 204 is designed to be positioned substantially vertically within the compressor housing 12 (see FIGS. 1 and 2). In the context of the present invention, "substantially vertically" indicates that the relatively longer portion 204 may be positioned vertically, or at a slight angle from vertical, such that oil may flow down the relatively longer portion 204 toward the oil sump 76 (shown in FIG. 1) unaided except by the force of gravity.

Further, in certain embodiments, the short tubular portion 202 attached such that it is perpendicular to the relatively longer tubular portion 204. In particular embodiments, the oil return tube 200 is configured to receive oil through an opening 210 in the short tubular portion 202 and to discharge the oil from an opening 214 in the relatively longer portion 204. The relatively longer tubular portion 204 is non-circular and has at least one stepped portion, or first stepped portion 206, to correspond with at least one stepped surface on the interior surface of the housing 12. In a more particular embodiment, the shape of the relatively longer tubular portion 204, and of the opening 214 therein, is one of obround or stadium-shaped, kidney-shaped, or oval.

In the embodiment shown, the oil return tube 200 has a second stepped portion 208. The first stepped portion 206 and second stepped portion 208 are separated by a non-stepped portion 212 of the relatively longer tubular portion 204.

The first stepped portion 206, at an upper end of the oil return tube 200, is configured to abut a stepped feature on the interior surface of the housing 12. In a further embodiment, the first stepped portion 206 follows a stepped contour of the interior surface of the housing 12 such that the stepped contour supports and positions the oil return tube 200.

The second stepped portion 208, at a lower end of the oil return tube 200, is configured to abut the outer surface of the drive unit 16 or motor 40. In the embodiments shown, the first stepped portion 206, at the upper end of the relatively longer tubular portion 204, is radially outward of the non-stepped portion 212, and the second stepped portion 208 is radially inward of the non-stepped portion 212.

While the oil return tube 200 may be made from various metals, other embodiments are made from injection-molded plastic or a similarly suitable material. Also, the short tubular portion 202 may be circular with a circular opening 210 therein. In this embodiment, the first stepped portion 206 abuts the drive unit 16 or motor 40.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor comprising:

a housing;

scroll compressor bodies disposed in the housing, the scroll compressor bodies including a drive unit disposed a first scroll body and a second scroll body, the first and second scroll bodies having respective bases and respective scroll ribs that project from the respective bases, wherein the scroll ribs mutually engage, the second scroll body being movable relative to the first scroll body for compressing fluid; in the housing, the drive unit providing a rotational output for operatively driving one of the scroll compressor bodies to facilitate relative movement of the scroll compressor bodies for the aforementioned compression of fluid; and an oil return tube for delivering oil from an upper region of the housing to an oil sump in a lower region of the housing, wherein the oil return tube comprises:

a tubular portion, wherein the tubular portion is positioned vertically within the housing, the tubular portion being non-circular;

wherein the tubular portion has a first stepped portion at an upper end of the tubular portion and a second stepped portion at a lower end of the tubular portion, and further comprising a non-stepped portion between the first and second stepped portions; and wherein the first stepped portion is radially outward of the non-stepped portion, and the second stepped portion is radially inward of the non-stepped portion.

2. The scroll compressor of claim 1, wherein the tubular portion includes at least one stepped portion which corresponds to a step in an interior surface of the housing.

3. The scroll compressor of claim 2, wherein the at least one stepped portion follows a stepped contour of the interior surface of the housing such that the stepped contour supports and positions the oil return tube.

4. The scroll compressor of claim 1, wherein the tubular portion includes at least one stepped portion which abuts the drive unit.

5. The scroll compressor of claim 1, wherein the oil return tube is made from injection-molded plastic.

6. The scroll compressor of claim 1, wherein a short tubular portion is attached at one end to the tubular portion.

7. The scroll compressor of claim 6, wherein the short tubular portion is perpendicular to the tubular portion.

8. The scroll compressor of claim 6, wherein the short tubular portion is circular.

9. The scroll compressor of claim 6, wherein the short tubular portion is disposed within an opening in a main bearing member.

10. The scroll compressor of claim 9, further comprising an O-ring configured to fit onto the shorter tubular portion to provide a seal between the shorter tubular portion and the opening in the main bearing member.

11. The scroll compressor of claim 6, wherein the oil return tube is configured to receive oil through an opening in the short tubular portion and to discharge the oil from an opening in the tubular portion.

12. The scroll compressor of claim 1, further comprising one or more guide strips placed on a radially-outward portion of the oil return tube, the one or more guide strips configured to facilitate the press-fitting of the oil return tube into the housing.

13. The scroll compressor of claim 1, wherein the drive unit is inserted into a motor spacer which is press-fit into the housing, and wherein the tubular portion is situated in a space between the housing and the drive unit.

14. The scroll compressor of claim 1, wherein a shape of the tubular portion, and of an opening therein, is obround.

15. The scroll compressor of claim 1, wherein a shape of the tubular portion, and of an opening therein, is either kidney-shaped or oval.

16. The scroll compressor of claim 1, wherein the tubular portion is configured to fit in a space between an interior surface of the housing and an exterior surface of the drive unit.

* * * * *